US005639026A

United States Patent [19]

Woods

[11] Patent Number: 5,639,026

[45] Date of Patent: Jun. 17, 1997

[54] DIRECTLY MOUNTABLE ADJUSTABLE SPRAY NOZZLE

[76] Inventor: John Woods, 4540 Willens Ave., Woodland Hills, Calif. 91364

[21] Appl. No.: 391,456

[22] Filed: Feb. 21, 1995

Related U.S. Application Data

[63] Continuation-in-part of Ser. No. 231,464, Apr. 22, 1994, Pat. No. 5,421,519, and Ser. No. 21,731, Apr. 22, 1994, Pat. No. Des. 358,989.

[51] Int. Cl.[6] ..... B05B 1/16

[52] U.S. Cl. ..... 239/394; 222/402.17

[58] Field of Search ..... 239/337, 373, 239/390, 391, 392, 394, 397, 537, 538, 581.1; 222/402.17

[56] References Cited

U.S. PATENT DOCUMENTS

| | | | |
|---|---|---|---|
| 3,083,872 | 4/1963 | Meshberg | 239/394 X |
| 3,704,831 | 12/1972 | Clark | 239/394 |
| 3,795,350 | 3/1974 | Shay | 222/402.17 |
| 3,891,128 | 6/1975 | Smrt | 239/394 X |
| 3,982,698 | 9/1976 | Anderson | 239/394 |
| 4,401,271 | 8/1983 | Hansen | 239/337 |
| 4,903,897 | 2/1990 | Hayes | 239/394 |

*Primary Examiner*—Andres Kashnikow
*Assistant Examiner*—Steven J. Ganey
*Attorney, Agent, or Firm*—Roger A. Marrs

[57] ABSTRACT

A multi-nozzle sprayer for high pressure fluid is disclosed herein adapted to be installed on the discharge nozzle of a pressurized spray container. The spray nozzle includes an elongated body having an open-ended central bore terminating at one end in a mounting tube and at its opposite end in a discharge orifice. A cap having multiple sized openings is rotatably carried on the body for selectively aligning a particular sized opening with the discharge orifice. Lateral ribs on the body terminate adjacent the mounting tube in cooperating arcuate surfaces matable with the container discharge nozzle so that the multi-nozzle sprayer will seat against the container nozzle when the tube is insertably received into the discharge nozzle thereof. A limit stop is provided for resisting insertion of the multi-nozzle sprayer into the container discharge nozzle and an indexing indicia is provided for aligning a selected discharge orifice with the body central bore.

6 Claims, 1 Drawing Sheet

DIRECTLY MOUNTABLE ADJUSTABLE SPRAY NOZZLE

RELATED APPLICATIONS

This is application is a continuation-in-part of application Ser. No. 08/231,464 filed on Apr. 22, 1994 titled ADJUSTABLE NOZZLE, now U.S. Pat. No. 5,421,519, and a continuation-in-part of application Ser. No. 29/021,731 filed Apr. 22, 1994 titled ADJUSTABLE NOZZLE FOR A PRESSURIZED CONTAINER, now U.S. Pat. No. 358,989.

BACKGROUND OF THE INVENTION

1. Field of the Invention

The present invention relates to the field of fluid discharge devices or dispensers, and more particularly to a novel adjustable nozzle having different sized discharge orifices available and which detachably connects to a pressurized supply of fluid substance held in a container that is intended to be held in one hand by the user in a variety of orientations for substance distribution.

2. Brief Description of the Prior Art

In the past, it has been the usual practice to distribute a substance from a pressurized container onto a supporting surface by using a finger depressible spray nozzle which is pointed directly at the surface so that discharge of the substance will be distributed as the user moves the container. Such a discharge nozzle is conventional and is associated with most aerosol containers for substances such as paint, oils, window washes or the like. The single discharge orifice on the conventional nozzle produces a wide spray so that the area to be covered by the substance is widely served and no selection of orifice size is available.

Problems and difficulties have been encountered when employing such conventional spray nozzles, which stem largely from the fact that no adjustment is offered by which different discharge orifice sizes can be selected- The single discharge nozzle orifice sometimes clogs or otherwise permits the buildup of semi-fluid substances which eventually blocks or prevents distribution of the substance onto the supporting surface. When only a single diameter of orifice size is available, there can be no adjustment for quantity of semi-fluid or fluid materials or substances intended to be distributed. The single diameter and shape of discharge orifice determines the spray density as well as substance distribution onto the receiving surface. No single discharge orifice size will permit proper distribution of a semi-fluid or fluid substance for all application needs. Separate tubes or straws of different diameters are disclosed in U.S. Pat. No. 5,310,095; however, these are not combined into a unitary structure and are separate from the dispensing nozzle requiring individual selection and storage.

Therefore, a long-standing need has existed to provide a novel discharge nozzle for pressurized fluids which is adjustable so as to permit selection of different sized discharge orifices to be aligned with a supply passageway so that the proper texture of semi-fluid or fluid can be discharged without clogging, accumulation of substance or undesired dripping from the nozzle. Preferably, the adjustable nozzle should be adapted for detachable connection to a spray container nozzle and permit discharge of the substance while the spray container is held in one hand.

SUMMARY OF THE INVENTION

Accordingly, the above problems and difficulties are avoided by the present invention which provides a novel nozzle having an adjustable selection of discharge orifices for distributing a quantity of fluid or semi-fluid substance onto a supporting surface. The nozzle is adjustable by the user to permit selection of a desired sized discharge orifice provided on a manually rotatable cap. The adjustable nozzle includes a supply tube which has open ends whereby one end is detachably connected to the discharge nozzle of a spray container while its opposite end is fixedly carried on a stationary mount or member. A rotatable discharge cap is movably carried on the mount or member and includes multiple discharge orifices. A selected discharge orifice is chosen by rotating the cap via finger selection of the user. The discharge cap includes multiple different shaped, sized or diametered discharge orifices which are placed in selective and coextensive alignment with the supply tube in the mount or member permitting discharge of the fluid substance from the spray container. Indexing or alignment means are provided on the discharge cap and mount or member so that alignment of a selected discharge orifice with the mount tube passageway is maintained.

Therefore, it is among the primary objects of the present invention to provide a novel discharge nozzle or apparatus for a pressurized fluid or semi-fluid substance in a spray container which will permit the selection of discharge orifice size so that the user may readily select a desired shape and or size for permitting discharge of the fluid or semi-fluid substance.

Another object of the present invention is to provide a novel adjustable discharge nozzle having multiple discharge orifices which are readily aligned with and selectively mated with a conventional supply discharge nozzle so that the substance to be distributed via the nozzle may be discharged from a selected one of the discharge orifices.

Still a further object of the present invention is to provide a novel adjustable spray nozzle having registration or indexing means for aligning a selective discharge orifice with a supply passageway while blocking non-selected orifices.

A further object of the present invention resides in providing a discharge nozzle having selective discharge orifices connected to a pressurized spray container whereby the container may be held in one hand by the user.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
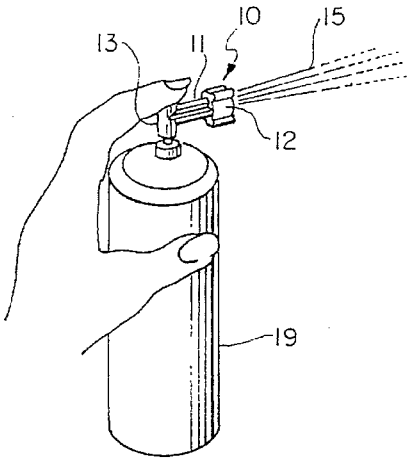
FIG. 1 is a perspective view showing the adjustable nozzle of the present invention used in combination with a spray container of pressurized substance.

Referring to FIG. 1, the novel adjustable nozzle of the present invention is illustrated in the general direction of arrow 10 which includes an elongated body or member 11 on which a rotatable cap 12 is mounted on one end thereof. The opposite end of the body 11 is insertably received into a conventional finger-depressing nozzle 13 which is carried on the top of a container 19. The container stores a quantity of semi-fluid or fluid pressurized substance, such as paint, acoustic material, oil or the like. Upon depression of the nozzle 13 in a conventional way, the pressurized substance within container 19 is expelled or discharged through a small opening in the nozzle 13. By using the adjustable-nozzle 10 incorporating the present invention, the body 11 includes a tube, identified by numeral 14 in FIG. 2, that is insertably received within the small opening of nozzle 13 and is held in place via interference fit. Thus, the discharge normally from the small opening in nozzle 13 is conducted through the adjustable nozzle 10 and issues therefrom in a spray, identified by numeral 15.

Figure 5:
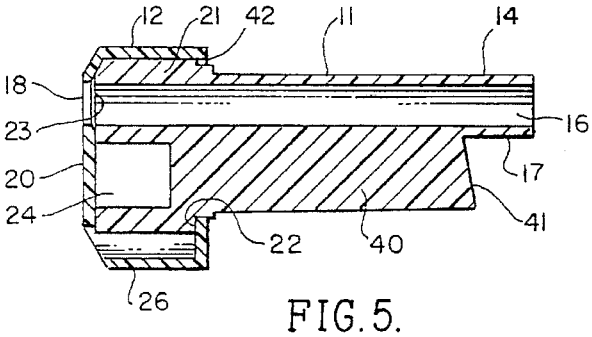
FIG. 5 is an enlarged longitudinal cross-sectional view of the adjustable nozzle used in the device of FIG. 3 as taken in the direction of arrows 5—5 thereof.

Referring now in detail to FIG. 5, it can be seen that the tube 14 in the body 11 includes an open-ended bore 16 wherein an end exposed portion 17 of the tube is used to be insertably received within the small opening of the nozzle 13, while the opposite end of the bore opens adjacent to the cap 12 and is intended to be in alignment with a selected discharge opening, such as opening 18 in the front face 20 of the cap 12. The body 11 includes an enlarged hub portion 21 on which the cap 12 is mounted and the cap 12 includes at least three detents, such as detent 22, which are intended to be snapped behind the trailing edge of the hub portion 21 to maintain the cap in position.

Figure 3:
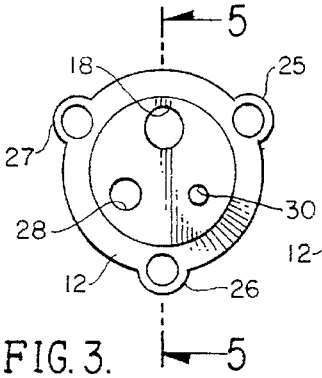
FIG. 3 is a front view of the adjustable nozzle shown in FIG. 2 illustrating the different sized discharge orifices.

In FIG. 5, it can be seen that the end of bore 16 adjacent to the face of cap 12 includes a chamfered portion 23 which prevents clogging or buildup of the pressurized substance as it is exhausted or discharged through the opening 18. A lightening aperture 24 is included in the end of the member 11 so as to conserve material during molding. Also, it can be seen that the cap 12 includes at least three raised portions, such as identified by numerals 25, 26 and 27 in FIG. 3. The raised portions serve to index or indicate alignment of the selected aperture with the end of bore 16. Also, it is to be noted that arrows 29 and 29' are carried as indicia on the cap and member so as to assist in indexing and alignment of the selected aperture with the bore. FIG. 3 further illustrates additional discharge orifices or openings, identified by numerals 28 and 30, which are of different sizes than the opening 18. Therefore, the user has a complete selection of size opening and of shape.

Figure 4:
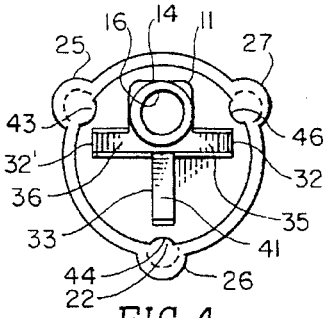
FIG. 4 is a rear elevational view of the adjustable nozzle shown in FIG. 2.

Referring now to FIG. 4, it can be seen that the body 11 is of cruciform configuration when looked at from the rear, having an upper portion 32 which is substantially horizontal and a substantially vertical and downwardly depending portion 33.

Figure 6:
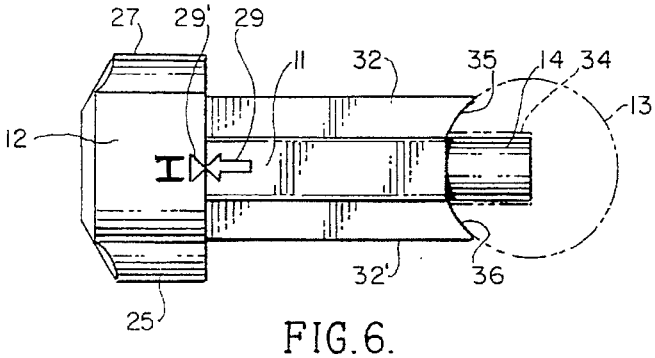
FIG. 6 is a top plan view of the adjustable nozzle.

In FIG. 6, it can be seen that the exposed end of tube 14 is insertably received within a discharge opening 34 of the conventional finger-depressed nozzle 13. Therefore, the adjustable nozzle of the present invention may be readily installed on any conventional spray can or container having such a nozzle thereon. Inasmuch as the nozzle 13 has a rounded shape in transverse cross-section, the member portion 32 and 32' on each side of the tube 14 is arcuate, such as identified by numerals 35 and 36 respectively so that the end of the body 11 will formfit against the exterior surface of the round nozzle 13, as illustrated.

Figure 2:
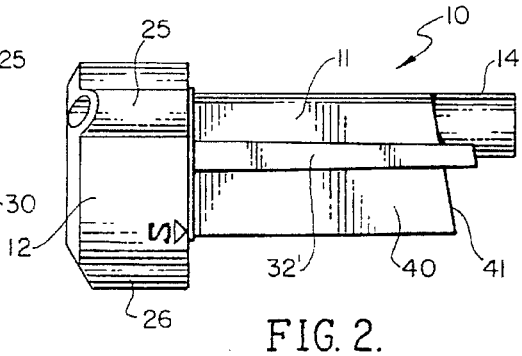
FIG. 2 is a side elevational view showing the rotatable discharge cap and the fixed mount or member used in the adjustable nozzle shown in FIG. 1.

FIGS. 2 and 6 show an identifying letter such as "S" or "H" which resides adjacent to each arrow on the cap. The letter, in turn, relates to an associated one of the discharge orifices 18, 28 and 30. Therefore, when the arrow 29 is aligned with a selected one of the "letters", its associated discharge orifice is in alignment with the bore 16.

The member 11 includes a downwardly depending section 40 which is formed with a rear sloping ramp 41. The slope is approximately 8 degrees and bears against the conventional discharge nozzle 13 when the tube 14 has been installed in the nozzle 13 opening.

Figure 7:
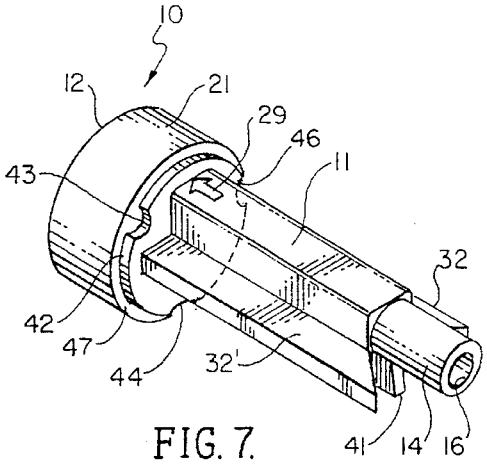
FIG. 7 is a rear perspective view of the nozzle.

FIG. 7 shows member 11 and a circular track 42 of reduced diameter as compared with the hub 21. The track 42 is interrupted by spaced-apart notches 43, 44 and 46 which receive the detents 22 as the cap is rotated about hub 21. The detents ride on the track and snap into the notches in releasable retention therewith. The detents are snapped behind the hub to mount the cap onto the member 11 with the detents 22 residing against shoulder 47.

In view of the foregoing, it can be seen that the cap 12 rotates on hub 21 and that by aligning a selected Small, Medium or Heavy (Large) indicia with arrow 29, the user has selected orifice 18, 28 or 30 with the bore 16. The member 11 is mounted to a conventional discharge nozzle 13 via tube 14 and the curved surfaces 35 and 36 as well as ramp 41 stabilize the nozzle 10 onto the conventional nozzle 13. Separate tubes or straws are unnecessary and totally avoided. Depending upon the angle of the ramp 41, the discharge from the nozzle 10 can be elevated with respect to the conventional nozzle 13. An 8 degree slope on the ramp produces an 8 degree elevational of substance discharge.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An adjustable nozzle for discharging a pressurized fluid from a container having a finger-operated discharge nozzle, the combination comprising:

an elongated body having a cylindrical hub at one end and a tube at its opposite end;

said body having an open-ended bore extending through said body communicating said hub with said tube;

a cap having a front face supporting a circular flange defining an open receptacle for rotatable mounting on said hub;

said cap front face having a center about which at least three discharge orifices are provided wherein each discharge orifice is of a different size and that are arranged in fixed spaced-apart relationship;

index means cooperatively carried on said cap and said body for selectively registering a selected one of said discharge orifices with said open-ended bore in response to rotation of said cap in said hub;

said finger-operated discharge nozzle on said container includes a discharge recessed opening for insertably receiving said tube of said body in interference fit so as to support said body and said cap in a cantilevered position projecting from said finger-operated discharge nozzle;

said body includes a main body portion with laterally extending portions and a downwardly projecting portion disposed between said lateral portions; and said downwardly projecting portion terminating adjacent said tube in a sloping ramp engageable with said finger-operating discharge nozzle.

2. The invention as defined in claim 1 wherein:

said finger-operated discharged nozzle is of cylinder configuration;

said body lateral portions terminating in arcurate surfaces on opposite sides of said tube and conformal with and matable with said cylindrical configuration of said finger-operated discharge nozzle.

3. The invention as defined in claim 1 wherein:

said body includes a continuous track immediately behind said hub and said cap having at least 3 tabs carried on said flange and said tabs disposed behind said hub to ride on said track in sliding engagement.

4. The invention as defined in claim 3 wherein:

said track includes at least three spaced-apart notches for yieldably receiving said tabs in response to rotation of said cap.

5. The invention as defined in claim 4 wherein:

said sloping ramp on said downwardly projecting portion is effective when engaged with said finger-operated nozzle to elevate the discharge from said selected discharge orifice at an 8 degree angle.

6. The invention as defined in claim 5 wherein:

said indexing includes visual indicia carried on said cap and said main body portion cooperating with said tab and notch engagement to yieldably retain said selected discharge orifice in alignment with said body bore.

* * * * *